United States Patent [19]

Whistler, Jr.

[11] 4,011,781

[45] Mar. 15, 1977

[54] CUTOFF DIE

[76] Inventor: Lawrence V. Whistler, Jr., 251 Doncaster Road, Kenmore, N.Y. 14217

[22] Filed: Jan. 9, 1976

[21] Appl. No.: 648,000

[52] U.S. Cl. ..... 83/387; 83/619; 83/620; 83/641; 83/694; 83/699; 83/926 H

[51] Int. Cl.[2] ..... B26D 7/02; B26D 7/26

[58] Field of Search ..... 83/694, 699, 698, 620, 83/619, 387, 926 H, 640, 641

[56] References Cited

UNITED STATES PATENTS

| | | | |
|---|---|---|---|
| 376,087 | 1/1888 | Halpin | 83/694 |
| 1,663,092 | 3/1928 | Parys | 83/694 |
| 1,787,815 | 1/1931 | Ditchfield | 83/699 X |
| 1,866,855 | 7/1932 | Kirsten | 83/694 |
| 2,204,405 | 6/1940 | Dunlap | 83/620 X |
| 2,539,602 | 1/1951 | Wehr | 83/694 |
| 2,593,144 | 4/1952 | Hercik | 83/694 |
| 2,707,025 | 4/1955 | Glitsch | 83/640 |
| 2,897,892 | 8/1959 | Duenke | 83/620 |
| 3,916,747 | 11/1975 | Murray | 83/698 |

*Primary Examiner*—Frank T. Yost
*Attorney, Agent, or Firm*—Bean & Bean

[57] ABSTRACT

A modular cutoff die unit features square-ended punch and die steels, which are supported by and sized relative to their respective retaining shoes such as to provide four reversable cutting edges and to allow plural cutoff dies to be arranged in tandem.

13 Claims, 5 Drawing Figures

Fig. 1.
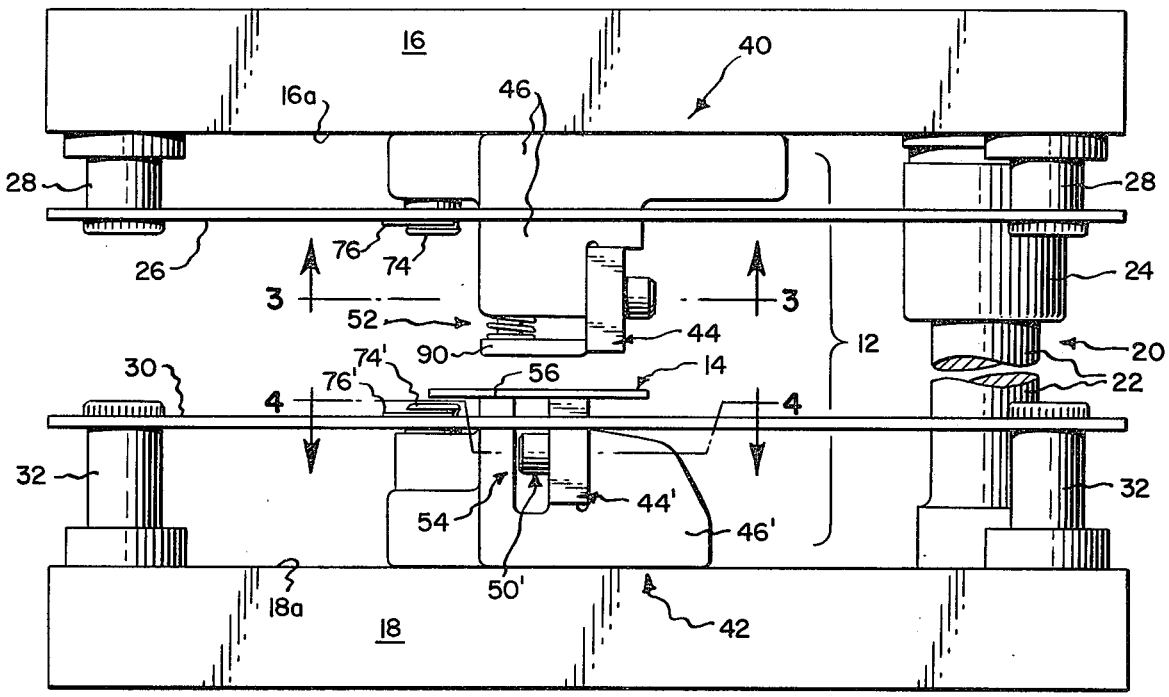
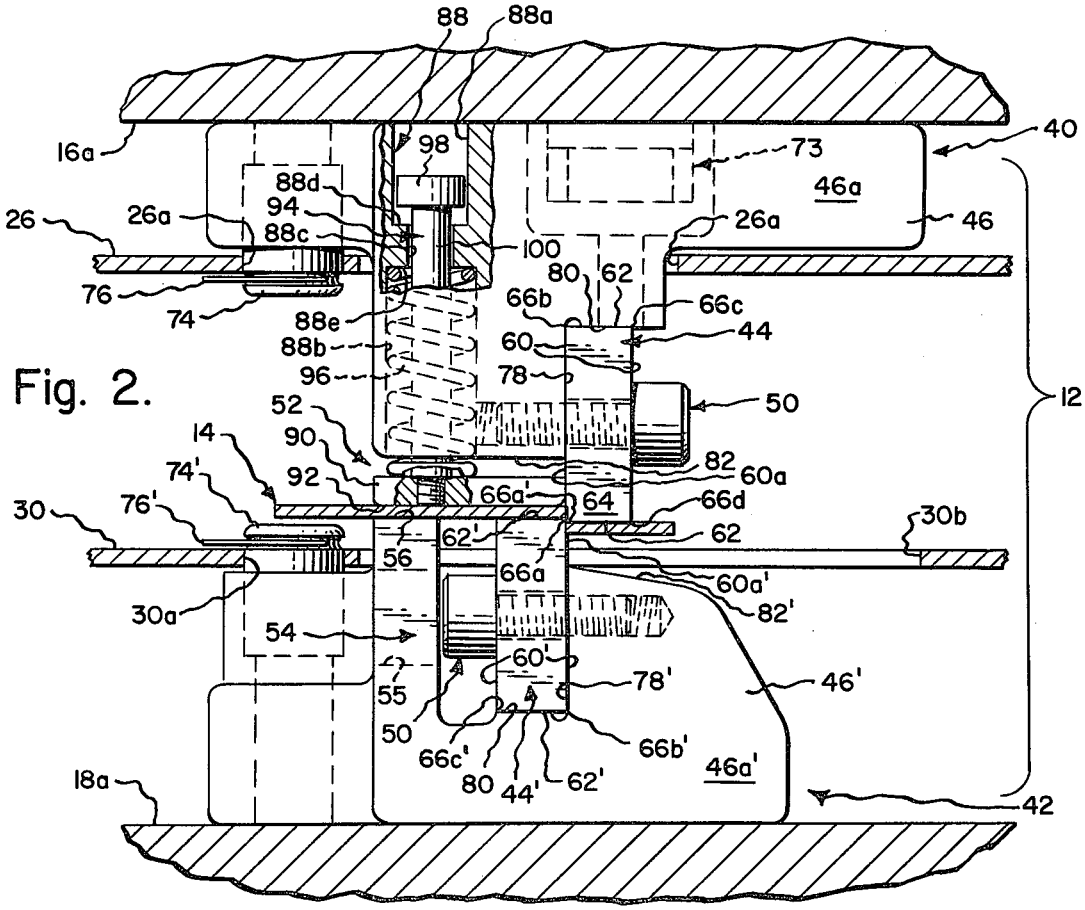
Fig. 2.

CUTOFF DIE

SUMMARY OF THE INVENTION

The present invention is directed towards a modular cutoff die unit, which is particularly adapted to provide a "cutting off" capability for magnetic punch holder and die holder assemblies of the type disclosed for instance in U.S. Pat. Nos. 3,089,376 and 3,782,166.

In an illustrated form of the present invention, the modular cutoff die unit comprises a punch blade-retaining shoe positionally located by a conventional punch templet and held against a punch shoe by magnetic means: a punch steel or blade removably fixed to the punch blade-retaining shoe; a die blade-retaining shoe positionally located by a conventional die templet and supported by a die shoe; a die steel or blade removably fixed to the die blade-retaining shoe; and a presser-foot assembly, which is mounted on the punch blade-retaining shoe and cooperates with the die blade-retaining shoe to positionally clamp a workpiece during a cutting operation.

A particularly important feature of the present invention is that the punch and die steels, which may be interchangeable, are shaped and supported relative to their associated shoes such as to provide four reversable cutting edges, which may be resharpened without necessitating change of reference spacing between the punch and die shoes.

A further feature of the present unit is its modular construction and the square-end design of the punch and die steels, which enable units to be arranged in tandem to form an overall cutting edge whose length is a multiple of the length of each punch and die steel.

While a presently proposed commercial form of the present modular cutoff die unit will be hereinafter described in detail, it is anticipated that the novel features of the present invention may be incorporated within cutoff die units of otherwise diverse construction.

DRAWINGS

The nature and mode of operation of the present invention will now be more fully described in the following detailed description taken with the accompanying drawings wherein:

FIG. 1 is a side elevational view of a die set mounting a modular cutoff die unit formed in accordance with the present invention;

FIG. 2 is an enlarged view of the modular cutoff die unit shown in FIG. 1, but with parts broken away for purpose of clarity;

Figure 3:
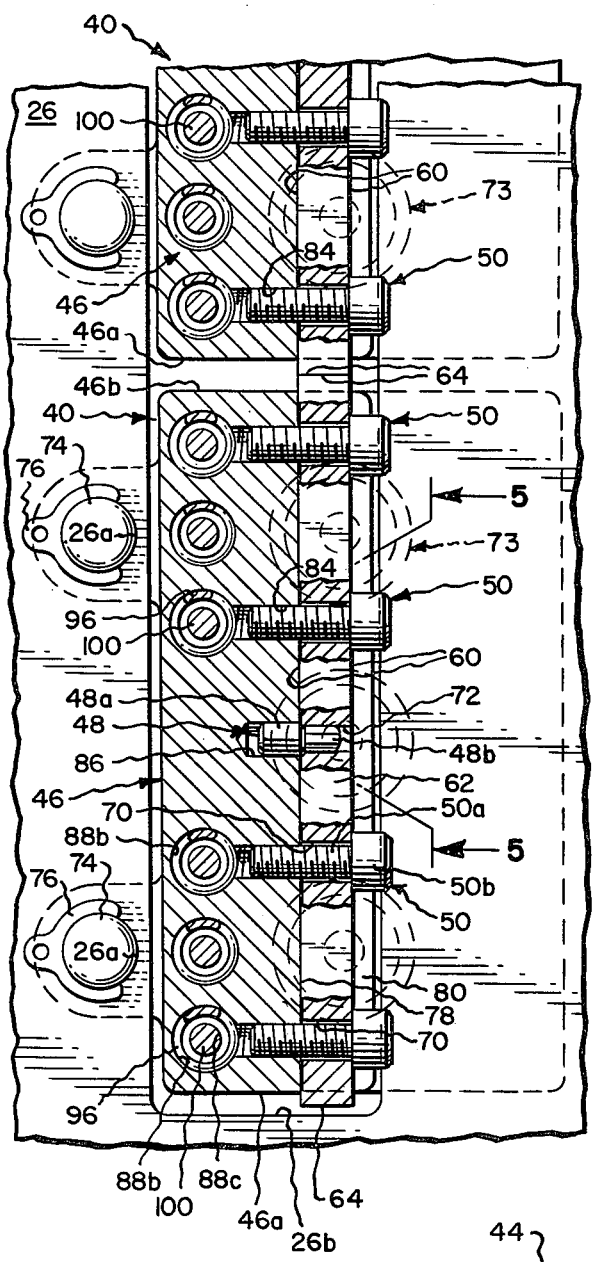
Figure 4:
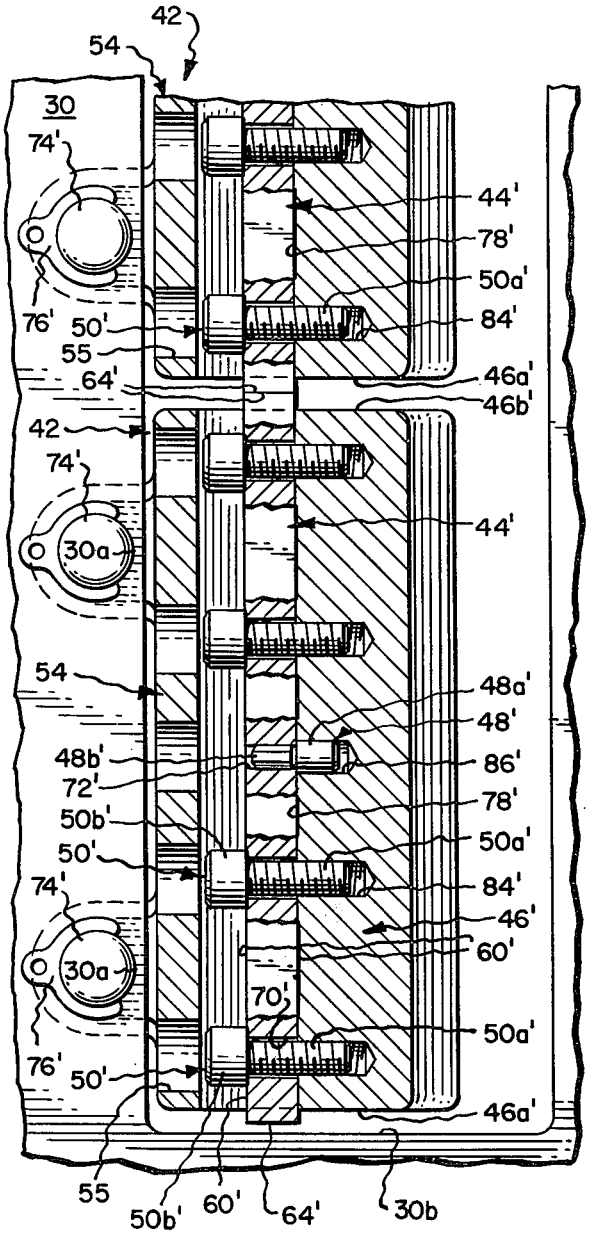
Figure 5:
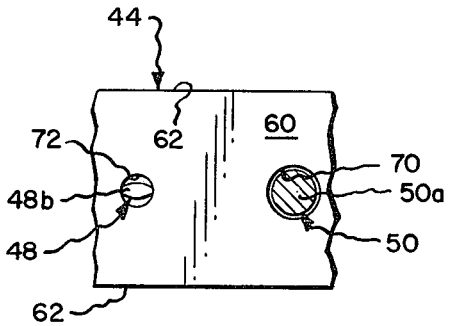

FIGS. 3 and 4 are sectional views taken generally along the lines 3—3 and 4—4 in FIG. 1, and further illustrating punch and die units, respectively, arranged in tandem; and FIG. 5 is a sectional view taken generally along the line 5—5 in FIG. 3.

DETAILED DESCRIPTION

Reference is first made to FIG. 1, wherein a conventional die set is generally designated as 10 and shown as mounting therewithin a modular cutoff die unit, which is formed in accordance with the present invention and generally designated as 12. A workpiece, such as a piece of sheet metal, on which a cutting operation is to be performed, is generally designated at 14.

Die set 10 is shown in FIG. 1 as generally including a punch shoe 16, which is adapted to be suitably secured to a press ram, now shown; a die shoe 18, which is adapted to be suitably secured to a press bolster, also not shown; a plurality of shoe guide assemblies 20, which include a die shoe mounted guide post 22 and a punch shoe mounted guide post receiving bushing 24; a punch templet 26, which is adapted to be releasably secured to punch shoe 16 by a plurality of templet support or locator posts 28; and a die templet 30, which is adapted to be removably secured to die shoe 18 by a plurality of templet support or locator posts 32. A more complete description of the construction of die set 10 may be had by reference to U.S. Pat. Nos. 3,089,376 and 3,782,166, whose disclosures are incorporated by reference herewithin.

In FIGS. 2–4, templets 26 and 30 are specifically shown as being formed with locator holes **26*a* and 30*a* and clearance openings 26*b* and 30*b*, which are sized, shaped and arranged to accommodate a plurality of identically sized modular cutoff die units 12 arranged in tandem. However, it will be understood that the specific design of these templets will vary with press setup requirements, that is, the number and relative size or cutting lengths of the modular cutoff die units to be employed and whether additional operations, such as perforating, notching, embossing, lancing, forming, knock-out, stamping, etc. are to be simultaneously performed on workpiece 14**.

By viewing FIGS. 1–4, it will be understood that each modular cutoff die unit 12 includes a pair of associated punch and die units 40 and 42, which are adapted to be suitably affixed to facing surfaces **16*a* and 18*a* of punch and die shoes 16 and 18, respectively, such that they are arranged in operative vertical registration in order to effect cutting-off of workpiece 14, whenever punch shoe 16** is caused to reciprocate between its upper or die set open position shown in FIG. 1 and its lower or die set closed position shown in FIG. 2.

Punch and die units 40 and 42 are similar in many respects. Therefore, in order to simplify the following description of the construction of unit 12, only punch unit 40 will be fully described in particular detail and the elements of die unit 42, which are of similar construction, will be designated in the drawings by like primed numerals. More specifically, punch unit 40 is similar to die unit 42 in that it generally includes an elongated steel or blade 44; a retainer shoe 46; and means in the form of a locator pin 48 and a plurality of bolts 50 for removable clamping and positionally orienting steel 44 relative to retainer shoe 46. Punch unit 40 principally differs from punch unit 42 in that its retainer shoe 46 is shaped to accommodate a workpiece presser-foot assembly 52, whereas the latter has its retainer shoe 46′ shaped to provide a support rib 54, which is formed with openings 55 for affording access to bolts 50 and defines a support surface 56 arranged to cooperate with its associated steel 44′ to provide a support for workpiece 14 in the manner best shown in FIGS. 1 and 2.

Reference is now made particularly to FIGS. 2, 3 and 5, wherein steel 44 is shown as being formed from a rectangular bar stock having squared ends, such that it assumes a rectangular parallelepiped configuration having parallel clamping or first surfaces 60, parallel bearing or second surfaces 62 and parallel end or third surfaces 64. Surfaces 60 and 62 cooperate at their junctures to define four cutting or shear edges **66*a*–66*d*, which extend lengthwise of the steel between end surfaces 64. Steel 44 is preferably provided with a plurality of mounting bore openings 70 and a single locator bore opening 72, which collectively open through clamping surfaces 60 and have their axes arranged in parallel and to lie within a common plane arranged equidistant from bearing surfaces 62. Moreover, as will be apparent from viewing FIG. 3, locator bore opening 72 is preferably disposed equidistant from end surfaces 64, and mounting openings 70** are arranged one-half on each side of the locator bore opening with the positional relationship of each half of such mounting openings relative to the locator bore opening being identical.

Retainer shoe 46 is shown as being in the form of a metal casting adapted to be removably fixed or suspended from the downwardly facing surface 16*a* of punch shoe 16 by means of magnet devices 73, which may be of the type disclosed for instance in U.S. Pat. Nos. 3,089,376 and 3,782,166, and to be horizontally positionally located within die set 10 to project downwardly through the temperate plate clearance opening 26*b* by means of locator posts 74 releasably locked within temperate locator openings 26*a* by snap rings 76. In that the force of gravity tends to maintain die retainer shoe 46' in bearing engagement with the upwardly facing surface 18*a* of die shoe 18, it is normally not necessary to provide the die retainer shoe with magnet devices of the type described above. While the illustrated means for attaching and positionally locating retainer shoes 46 and 46' is preferred, it will be understood that any other suitable means may be employed.

By now making reference to FIGS. 2 and 3, it will be seen that retainer shoe 46 is shaped to define a horizontally elongated and vertically disposed retainer clamping surface 78; a retainer bearing surface 80, which extends horizontally and in a right angular relationship from adjacent one marginal edge of surface 78; and a retainer clearance surface 82, which extends from adjacent an opposite and parallel marginal edge of surface 78 in a direction away from retainer bearing surface 80. Preferably, the lengthwise direction of retainer shoe 46, as measured horizontally and lengthwise of surfaces 78 and 80 between opposite ends of the retainer shoe, which are designated as 46*a* and 46*b*, is less than the lengthwise dimension of steel 44, as measured between end surfaces 64. Further, the widthwise or vertical dimension of retainer clamping surface 78 is substantially less than the widthwise dimension of clamping surfaces 60, as measured between bearing surfaces 62. Thus, when steel 44 is fixed to retainer shoe 46 in the manner to be described, the ends of the steel may be arranged to project outwardly beyond opposite ends 46*a* and 46*b*, and clamping surface 60, which engages with retainer clamping surface 78, has a portion thereof designated as 60*a* arranged to project beyond retainer clearance 82.

Retainer shoe 46 is also formed with a plurality of threaded openings 84 and a single locator receiving opening 86, which is preferably disposed equidistant from end surfaces 46*a* and 46*b*. Openings 84 and 86 collectively open through clamping surfaces 78 and have their axes disposed in a parallel relationship and to lie within a common plane, which is arranged parallel to retainer bearing surface 80 and spaced therefrom through a distance corresponding to a spacing between locator receiving bore opening 72 of steel 44 and steel bearing surfaces 62.

Retainer shoe 46 is additionally formed with a plurality of stepped diameter bore mounting openings 88, which are arranged in a parallel spaced relationship and open downwardly through retainer clearance surface 82 in the manner best shown in FIGS. 2 and 3. By referring specifically to FIG. 2, it will be understood that each of mounting openings 88 includes an enlarged diameter upper portion 88*a*, an enlarged diameter lower portion 88*b* and a reduced diameter central or connecting portion 88*c*, which cooperate to define upwardly and downwardly facing annular shoulders or abutment surfaces 88*d* and 88*c* disposed concentrically of central portion 88*c*.

Locator pin 48 is best shown in FIGS. 3 and 5 as having a cylindrically shaped end portion 48*a*, which is sized to be snugly received within locator receiving opening 86, and an opposite, "non-round" end portion 48*b*, which is sized to be slidably received within locator bore opening 72. Preferably, end porton 48*b* is of a generally oval cross-sectional configuration and arranged such that it slidably engages only with facing wall surfaces of locator bore opening 72, which are arranged immediately adjacent opposite sides of a common plane passing through openings 70 and 72. This arrangement serves to accurately center steel 44 in a direction lengthwise of retainer shoe 46, such that the ends of steel 44 are equidistant from retainer shoe surfaces 46*a* and 46*b*, while at the same time not interfering with the seating of steel bearing surfaces 62 in surface-to-surface engagement with retainer bearing surface 80.

Again referring to FIGS. 3 and 5, it will be seen that bolts 50 are formed with threaded shank portions 50*a*, which are sized to be loosely accommodated within steel mounting openings 70 and be threadably received within retainer shoe openings 86; and enlarged head portions 50*b*, which are adapted to be arranged to clampingly engage that one of steel clamping surfaces 60 spaced from engagement with retainer clamping surface 78. It will be understood that the sole purpose of bolts 50 is to clamp steel 44 against retainer clamping surface 78 after such steel has been accurately located vertically and horizontally relative to retainer shoe 46 by retainer bearing surface 80 and locator pin 48, respectively.

The positional relationship of threaded openings 84 relative to locator receiving opening 86 and their positional relationship relative to retainer bearing surface 82 is preferably identical to the positional relationship of mounting bore openings 70 relative to locator bore opening 72 and their positional relationship to bearing surfaces 56. This permits clamping surfaces 60 to be alternately clamped against retainer bearing surface 78 with bearing surfaces 62 alternately disposed in bearing engagement with retainer bearing surface 80, whereby to selectively position cutting edges 66*a*–66*d* one at a time in an operative cutting position relative to retainer shoe 46, which is shown in FIG. 2 as being occupied by cutting edge 66*a*. Thus, that one of the four cutting edges, which at any given time constitutes the operative cutting edge of steel 44, is defined by that one of clamping surfaces 60, which is arranged in engagement with retainer clamping surface 78, and an outer one of bearing surfaces 62, which is spaced from engagement with retainer bearing surface 80. In the preferred form of the present invention, punch steel 44 and die steel 44' are of identical size and construction in order to permit interchangeable mounting thereof on the punch and die retainer shoes.

It will be appreciated that the above described arrangement of parts permits resharpening of cutting edges 66*a*–66*d* by the simple expedient of grinding clamping surfaces 60; the resultant reduction in thickness of steel 44 being compensated for by forming threaded openings 84 of a depth sufficient to prevent bolt shank portions 50*a* from "bottoming out", until the steel has been ground to some given minimum or design thickness requiring its replacement. Also, it will be appreciated that this mode of resharpening cutting edges 66*a*–66*d* does not change the placement of the operative cutting edge of the steel relative to either retainer clamping surface 80 or retainer bearing surface 82, and therefore avoids time consuming adjustment of units 40 and 42 relative to one another in a horizontal direction and/or adjustments of the die set closed position of punch unit 16, which would otherwise be required. Further, the above described method of sharpening the cutting edges of steels 44 and 44' possesses the additional advantage that the coplanar relationship of rib support surface 56 and the upper steel bearing surface 62' is not altered during the useful life of steel 44'.

Again referring to FIGS. 2 and 3, it will be understood that workpiece presser-foot assembly 52 includes a presser-foot or plate having a generally rectangular and downwardly facing presser or pressure surface 92; a plurality of guide or support rods 94, which are slidably supported one within each of mounting openings 88 and serve to mount presser foot 90 within an elongated recess defined by retainer clearance surface 82 and projecting portion 60*a* of clamping surface 60 for vertically directed reciprocating movements between its extended and retracted positions shown in FIGS. 1 and 2, respectively; and suitable bias means, such as a plurality of coil type compression spring devices 96, which are operable to normally maintain presser foot 90 in its extended position. Each of support rods 94 includes rod head and shank portions 98 and 100, which are guided for vertically directed reciprocating movements within associated mounting opening upper and central portions 88*a* and 88*c*, respectively, such that each rod shank portion 100 extends downwardly through its associated mounting opening lower portion 88*b* and beyond clearance surface 82 for threaded attachment with presser foot 90. Spring devices 96 are arranged one concentrically of each of shank portions 100 for opposite end bearing engagement with downwardly facing annular abutment surfaces 88*b* and the upwardly facing surface of presser foot 90, and thereby normally serve to bias the presser foot into its above mentioned extended position, which is determined by engagement of rod head portions 98 with upwardly facing annular abutment surfaces 88*d*.

By again referring to the drawings, it will be understood that the positional relationship of locator openings 26*a* and 30*a* relative to one another and locator posts 74 and 74', serves to horizontally positionally locate punch and die units 40 and 42 of each die unit 12 such that the axes of their locator pin receiving openings 86 and 86' are parallel and lie within a common vertically disposed plane; retainer clamping surfaces 78 and 78' are parallel and arranged to face in opposite directions; and presser surface 92 is disposed parallel to and arranged to bridge across rib support surface 56 and the upper bearing surface 62' of steel 44'. As a result, steels 44 and 44' are positioned such that bearing surfaces 62 and 62' are parallel; their respective end surfaces 64 and 64' lie in a coplanar relationship; and clamping surfaces 60 and 60', which engage with retainer clamping surfaces 78 and 78', are parallel and face in opposite directions. The spacing between projecting portions 60*a* and 60*a'*, as measured in a direction normal thereto, is such as to insure proper cutting off or shearing of workpiece 14 as portions 60*a* and 60*a'* are moved between their offset and lapping positions shown in FIGS. 1 and 2, respectively.

By viewing FIGS. 3 and 4, it will be understood that the positional relationship of locator openings 26*a* and 30*a* relative to one another and locator posts 74 and 74' additionally serves to horizontally positionally locate punch and die units 40 and 42 of adjacently disposed or tandemly arranged die units 12, such that the steel end surfaces 64 and 64' of adjacent units are arranged in proximate surface engagement and the operative cutting edges of adjacent ones of steels 44 and 44' are disposed in an aligned, end to end relationship in order to effect cutting-off of workpiece 14 along a line whose length corresponds to the sum of the lengths of the operative cutting edges of adjacent units. While it is preferable from the standpoint of manufacturing and inventory considerations to provide only a single size modular cutoff die unit, such that the total length of cut is a multiple of the length of the operative cutting edge of the die steels employed in each unit, it would, however, be possible to provide the units in various sizes as desired.

As indicated above, the positional location of the modular cutoff die unit 12 within die set 10 and the number of such units to be arranged in tandem will be determined by press set up requirements. Once these requirements have been determined, appropriately sized and arranged locator holes and clearance openings are formed in templets 26 and 30 to insure that punch and die units 40 and 42 of each unit 12 are arranged in operative vertical registration when these punch and die units are fixed to their associated templets and the latter fixed to the punch and die shoes in the manner shown in FIG. 1. Thereafter, a workpiece 14 to be severed is placed on die unit 42 for supporting engagement with rib support surface 56 and the upwardly facing bearing surface of steel 44'. The workpiece may thereafter be severed by causing movement of punch shoe 16 downwardly towards die shoe 18 into the die set closed position shown in FIG. 2. During closing movements of punch shoe 16, presser foot 90 resides in its extended position relative to punch retainer shoe 46 until presser surface 92 is brought into engagement with the upper surface of workpiece 14, whereby to arrest continued downwardly directed movement of presser foot 90 while causing relative movement between presser foot 90 and punch retainer shoe 48 against the bias of springs 96, as the punch retainer shoe moves towards and into its die closed position shown in FIG. 2. The arrangement is such as to allow for the positive clamping of workpiece 14 prior to initiation of the cutting-off operation in order to prevent horizontal displacements of the workpiece, which would otherwise occur incident to the passage of steel 44 through the workpiece.

While a presently proposed commercial form of the modular cutoff die unit has been described in detail, it is anticipated that the several novel features of such unit may be incorporated within cutoff die units of otherwise diverse construction. Thus, as by way of example, the present die unit is not limited in use by the specific manner in which its associated punch and die units are positionally fixed within a die set nor by the construction of such die set. Moreover, it is anticipated that the feature of forming one or both of the punch and die steels with four selectively positioned cutting edges may be employed in cutoff units, which are not intended to be arranged in tandem and therefore may omit the locator pins or comparable steel centering devices. On the other hand, it is contemplated that punch and die steels characterized as having only a single cutting edge may be centered relative to their associated retainer shoes by means of locator pins or comparable devices in order to permit two or more cutoff die units to be arranged in tandem.

I claim:

1. In a device for severing a workpiece including a punch unit, a die unit each of said punch and die units having at least one elongated cutting edge adapted to be arranged in an operative cutting position, and means for moving said punch and die units relatively towards one another with said cutting edges arranged in said operative cutting position to effect severing of said workpiece, wherein at least one of said punch and die units includes a steel having a rectangular cross-sectional configuration defined by parallel clamping surfaces and parallel bearing surfaces, said clamping and bearing surfaces cooperating to form at their junctures four elongated cutting edges; a retainer for supporting said steel, said retainer defining a retainer clamping surface arranged parallel to the direction of movement of said punch and die units relatively towards one another and a retainer bearing surface arranged normal to said retainer clamping surface and connected to said retainer clamping surface along a marginal edge thereof training in said direction of movement, and clamping means for releasably clamping said clamping surfaces alternately in engagement with said retainer clamping surface with said bearing surfaces alternately disposed in bearing engagement with said retainer bearing surface for selectively placing said four cutting edges one at a time in said operative cutting position; the improvement in combination, characterized in that said steel has squared ends and a lengthwise dimension as measured between said squared ends in excess of the lengthwise dimension of said retainer as measured lengthwise between opposite ends of said retainer clamping and bearing surfaces, and said steel is formed with a locator receiving bore opening extending between said clamping surfaces and being arranged centrally thereof, said retainer is formed with a locator receiving opening passing through said retainer clamping surface and arranged centrally between said opposite ends and spaced from said retainer bearing surface through a distance corresponding to the spacing between said locator receiving bore opening and said bearing surfaces, said one of said punch and die units additionally includes a locator pin having first and second ends, said first end being positionally fixed within said locator receiving opening of said retainer, and said second end is shaped and sized to slidably engage only with facing wall surfaces of said locator receiving bore opening disposed immediately adjacent a plane passing centrally through said locator receiving bore opening and arranged parallel to said bearing surfaces, whereby said second end and said facing wall surfaces cooperate to center said steel in a direction lengthwise of said retainer clamping surface with said squared ends projecting equidistances beyond said opposite ends.

2. In a device for severing a workpiece including a punch unit, a die unit, each of said punch and die units having at least one elongated cutting edge adapted to be arranged in an operative cutting position, and means for moving said punch and die units relative towards one another with said cutting edges arranged in said operative cutting position to effect severing of said workpiece, wherein at least one of said punch and die units includes a steel having a rectangular cross-sectional configuration defined by parallel clamping surfaces and parallel bearing surfaces, said clamping and bearing surfaces cooperating to form at their junctures four elongated cutting edges, a retainer for supporting said steel, said retainer defining a retainer clamping surface arranged parallel to the direction of movement of said punch and die units relatively towards one another and a retainer bearing surface arranged normal to said retainer clamping surface and connected to said retainer clamping surface along a marginal edge thereof trailing in said direction of movement, and clamping means for releasably clamping said clamping surfaces alternately in engagement with said retainer clamping surface with said bearing surfaces alternately disposed in bearing engagement with said retainer bearing surface for selectively placing said four cutting edges one at a time in said operative cutting position, said clamping means including a plurality of parallel bore openings formed in said steel to extend between said clamping surfaces, said bore openings having their axes arranged in a common plane disposed parallel to and equidistant from said bearing surfaces, a plurality of parallel threaded openings formed in said retainer and arranged to open through said retainer clamping surface, said threaded openings having their axes arranged in a common plane disposed parallel to said retainer bearing surface and spaced therefrom through a distance corresponding to that between the first said common plane and said bearing surfaces, said bore openings and said threaded openings being arranged within their respective planes to permit alignment thereof when either of said clamping surfaces is disposed in engagement with said retainer clamping surface with either of said bearing surfaces disposed in engagement with said retainer bearing surface, and a plurality of bolts having head and shank end portions, said shank end portions being insertable through said bore openings for threaded engagement within said threaded openings whereby to positionally clamp said steel intermediate said head portions and said retainer clamping surface, and said bore openings being sized to loosely receive said shank end portions; the improvement in combination, characterized in that said steel has parallel end surfaces disposed normal to said clamping and bearing surfaces thereof and a lengthwise dimension as measured between said end surfaces in excess of the lengthwise dimension of said retainer as measured lengthwise between opposite ends of said retainer clamping and bearing surfaces, said steel being additionally formed with a locator receiving bore opening extending between said clamping surfaces and disposed within the first said common plane parallel to said bore openings and equidistant from said end surfaces, said retainer is additionally formed with a locator receiver opening passing through said retainer clamping surface and arranged essentially equidistant from said opposite ends and to lie within the second said common plane in parallel relationship with said threaded openings, and said one of said punch and die units additionally includes a locator pin having a first end positionally fixed within said locator receiving opening of said retainer and a second end adapted to be slidably received within said locator receiving bore opening, said second end being shaped and sized to slidably engage only facing wall surfaces of said locator receiving bore opening disposed immediately adjacent the first said common plane, whereby said second end and said facing wall surfaces cooperate to center said steel in a direction lengthwise of said retainer clamping surface with said end surfaces projecting equidistances beyond said opposite ends.

3. A device according to claim 2, wherein each of said units includes said steel and said retainer and said bolts and said locator pin, and said steel of said punch unit is interchangeable with said steel of said die unit.

4. In a device for severing a workpiece including a punch unit, a die unit, each of said punch and die units having at least one elongated cutting edge adapted to be arranged in an operative cutting position, and means for moving said punch and die units relatively towards one another with said cutting edges arranged in said operative cutting position to effect severing of said workpiece, each of said punch and die units including a steel having a rectangular cross-sectional configuration defined by parallel clamping surfaces and parallel bearing surfaces, said clamping and bearing surfaces cooperating to form at their junctures four elongated cutting edges, a retainer for supporting said steel, said retainer defining a retainer clamping surface arranged parallel to the direction of movement of said punch and die units relatively towards one another and a retainer bearing surface arranged normal to said retainer clamping surface and connected to said retainer clamping surface along a marginal edge thereof trailing in said direction of movement, and clamping means for releasably clamping said clamping surfaces alternately in engagement with said retainer clamping surface with said bearing surfaces alternately disposed in bearing engagement with said retainer bearing surface for selectively placing said four cutting edges one at a time in said operative cutting position, the improvement comprising in combination: the clamping surfaces of the retainers of said punch and die units being arranged in an essentially coplanar relationship and disposed to face in opposite directions, said punch unit additionally including a presser foot assembly having a presser foot disposed immediately adjacent its associated steel, said pressure foot defining a presser surface arranged in a facing relationship relative to said die unit and in a parallel offset relationship relative to an outer one of said bearing surfaces of its associated steel spaced from bearing engagement with said bearing surface of its associated retainer, and support means for supporting said presser foot for movement between extended and retracted positions wherein said presser surface is disposed forwardly and rearwardly of said outer one of said bearing surfaces, respectively, said support means establishing a bias tending to move said presser foot towards said extended position, and said retainer of said die unit includes a support rib, said support rib being spaced from said clamping surface of said retainer of said die unit for accommodating its associated steel therebetween, said support rib defining a support surface arranged in a facing relationship relative to said punch unit and in an offset and essentially coplanar relationship relative to an outer one of said bearing surfaces of its associated steel spaced from bearing engagement with said bearing surface of its associated retainer, said support surface and its associated said outer one of said bearing surfaces cooperating to support said workpiece, said presser surface being sized to bridge across said support surface and its associated said outer one of said bearing surfaces and to cooperate therewith to clamp said workpiece therebetween upon movement of said punch and die units relatively towards one another, and engagement of said presser surface with said workpiece causing movement of said presser foot into said retracted position against said bias.

5. A device according to claim 4, wherein each of said clamping means comprises a plurality of parallel bore openings formed in said steel to extend between said clamping surfaces, said bore openings having their axes arranged in a common plane disposed parallel to and equidistant from said bearing surfaces; a plurality of parallel threaded openings formed in said retainer and arranged to open through said retainer clamping surface, said threaded openings having their axes arranged in a common plane disposed parallel to said retainer bearing surface and spaced therefrom through a distance corresponding to that between the first said common plane and said bearing surfaces, said bore openings and said threaded openings being arranged within their respective planes to permit alignment thereof when either of said clamping surfaces is disposed in engagement with said retainer clamping surface with either of said bearing surfaces disposed in engagement with said retainer bearing surface; and a plurality of bolts having head and shank end portions, said shank end portions being insertable through said bore openings for threaded engagement within said threaded openings whereby to positionally clamp said steel intermediate said head portions and said retainer clamping surface, said bore openings being sized to loosely receive said shank end portions, and said support rib being formed with a plurality of openings extending therethrough and arranged in alignment with said threaded openings opening through said clamping surface of said retainer of said die unit, said openings of said support rib being sized to permit passage of said head end portions of said bolts therethrough for clamping surface engagement with said steel associated with said retainer of said die unit.

6. A device according to claim 5, wherein said steel of said punch unit is of like size and interchangeably mounted with said steel of said die unit, each said steel has parallel end surfaces disposed normal to said clamping and bearing surfaces thereof and a lengthwise dimension as measured between said end surfaces in excess of the lengthwise dimension of said retainer of each of said punch and die units as measured lengthwise between opposite ends of said retainer clamping and bearing surfaces thereof, and there is additionally provided in combination means operable to center each said steel in a direction lengthwise of said retainer clamping surface of each said retainer with said end surfaces thereof projecting equidistances beyond said opposite ends of such retainer.

7. In a die set having punch and die shoes mounted for relative movement between remote open and adjacent closed positions; at least one modular cutoff die unit including punch and die units, each of said punch and die units including a steel, a retainer and clamping means, said steel having a rectangular cross-sectional configuration defined by parallel clamping surfaces and parallel bearing surfaces, said clamping and bearing surfaces cooperating to form at their junctures four elongated cutting edges, said retainer defining a retainer clamping surface, a retainer bearing surface extending in a right angular relationship from adjacent one marginal edge of said retainer clamping surface and a retainer clearance surface extending from adjacent an opposite marginal edge of said retainer clamping surface and in a direction away from said retainer bearing surface, said clamping means releasably clamping said clamping surfaces alternately in engagement with said retainer clamping surface with said bearing surfaces alternately disposed in bearing engagement with said retainer bearing surface, one of said four cutting edges defined by said clamping surface arranged in clamping engagement with said retainer clamping surface and an outer one of said bearing surfaces spaced from bearing engagement with said retainer bearing surface defining an operative cutting edge of said steel, said clamping surfaces of said steel having a widthwise dimension in excess of the distance between said marginal edges of said retainer clamping surface, whereby a portion of said clamping surface engaging said retainer clamping surface protrudes beyond said retainer clearance surface; and means to mount said punch unit and said die unit on facing surfaces of said punch and die shoes, respectively, and to position said portion of said clamping surface of said steel associated with said punch unit and said portion of said clamping surface of said steel associated with said die unit in an essentially parallel and oppositely facing relationship and for movement between offset and lapping positions upon movement of said punch and die shoes between said open and closed positions, respectively, whereby said operative cutting edge of said steel associated with said punch unit and said operative cutting edge of said steel associated with said die unit cooperate to effect cutting of a workpiece arranged intermediate said punch and die units, the improvement comprising in combination:

said steel has squared ends and a lengthwise dimension as measured between said squared ends in excess of the lengthwise dimension of said retainer as measured lengthwise between opposite ends of said retainer clamping and bearing surfaces, and said steel is formed with a through locator receiving bore opening, said locator receiver bore opening extending between said clamping surfaces and being arranged centrally thereof, said retainer is formed with a locator receiving opening passing through said retainer clamping surface and arranged centrally between said opposite ends and spaced from said retainer bearing surface through a distance corresponding to the spacing between said locator receiving bore opening and said bearing surfaces, and there is additionally provided in combination a locator pin having first and second ends, said first end being positionally fixed within said locator receiving opening of said retainer, and said second end is shaped and sized to slidably engage only with facing wall surfaces of said locator receiving bore opening disposed immediately adjacent a plane passing centrally through said locator receiving bore opening and arranged parallel to said bearing surfaces, whereby said second end and said facing wall surfaces cooperate to center said steel in a direction lengthwise of said retainer clamping surface with said squared ends projecting equidistances beyond said opposite ends.

8. A device according to claim 7, wherein said clamping means comprises a plurality of parallel bore openings formed in said steel to extend between said clamping surfaces, said bore openings having their axes arranged in said plane, a plurality of parallel threaded openings formed in said retainer and arranged to open through said retainer clamping surface, said threaded openings having their axes arranged in a common plane disposed parallel to said retainer bearing surface and spaced therefrom through a distance corresponding to that between the said plane and said bearing surfaces, said bore openings and said threaded openings being arranged within their respective planes to permit alignment thereof when either of said clamping surfaces is disposed in engagement with said retainer clamping surface with either of said bearing surfaces disposed in engagement with said retainer bearing surface, and a plurality of bolts having head and shank end portions, said shank end portions being insertable through said bore openings for threaded engagement within said threaded openings whereby to positionally clamp said steel intermediate said head portions and said retainer bearing surface, and said bore openings being sized to loosely receive said shank end portions.

9. A device according to claim 8, wherein said punch unit additionally includes a presser foot assembly having a presser foot disposed in a superimposed relationship to said retainer clearance surface of said punch unit, said presser foot defining a presser surface arranged in a facing relationship relative to said die unit and disposed parallel relative to said outer one of said bearing surfaces of its associated steel, and support means for supporting said presser foot on said retainer of said punch unit for movement between extended and retracted positions wherein said presser surface is disposed forwardly and rearwardly of said outer one of said bearing surfaces, respectively, said support means establishing a bias tending to move said presser foot towards said extended position, and said retainer of said die unit includes a support surface arranged in a facing relationship relative to said punch unit and in an offset and essentially coplanar relationship relative to an outer one of said bearing surfaces of its associated steel spaced from bearing engagement with said bearing surface of its associated retainer, said supporting surface and its associated said outer one of said bearing surfaces cooperating to support said workpiece, said presser surface being sized to bridge across said supporting surface and its associated said outer one of said bearing surfaces and to cooperate therewith to clamp said workpiece therebetween upon movement of said punch and die units relatively towards one another, and engagement of said presser surface with said workpiece causing movement of said presser foot into said retracted position against said bias.

10. A device according to claim 9, wherein said steel of said punch unit is interchangeable with said steel of said die unit.

11. In a die set having punch and die shoes mounted for relative movement between remote open and adjacent closed positions, and at least two modular cutoff die units, each of said modular cutoff die units including a punch unit and a die unit having operative cutting edges, and means to removably fix said punch and die units to said punch and die shoes, respectively, and in a tandem relationship wherein said operative cutting edges of each modular cutoff die unit are arranged to cooperate for cutting a workpiece disposed therebetween upon relative movement of said punch and die shoes between said open and closed positions and said operative cutting edges of adjacent punch units and of adjacent die units are arranged in an aligned end-to-end relationship to effect cutting of said workpiece along a straight line whose length corresponds to the sum of the lengths of said operable cutting edges of said adjacent units, the improvement comprising: each of said punch and die units includes a retainer shoe fixed to its associated one of said punch and die shoes, a steel having at least one cutting edge and means to positionally clamp said steel to its associated retainer shoe whereby its said one cutting edge becomes said operable cutting edge of its associated one of said punch and die units, each said steel having a length measured along its said one cutting edge in excess of the length of its associated retainer shoe, and the last said means includes means to center each said steel lengthwise of its associated retainer shoe whereby ends of said steel project equal distances beyond opposite ends of its associated retainer shoe in a direction aligned with its said one cutting edge, and said means to removably fix said punch and die units serve to position adjacent ones of said ends of the steels of adjacent punch units and die units in proximate surface to surface engagement.

12. In a die set according to claim 11, wherein each said steel has four cutting edges adapted to be selectively arranged to define said operable cutting edge.

13. A steel adapted for use interchangeably as a punch and die steel of a cutoff unit, said steel being of a rectangular parallelepiped configuration defined by parallel first and parallel second side surfaces and parallel end surfaces, said first and second side surfaces cooperating at their junctures to define four cutting edges extending between said end surfaces, said first surfaces having a widthwise dimension in excess of the widthwise dimension of said second surfaces, said steel being formed with a single steel locator bore opening and at least two steel mounting bore openings, said locator and mounting bore openings extending between said first surfaces and having their axes arranged in parallel and located within a common plane arranged equidistant from said second surfaces, said locator bore opening being arranged equidistant from said end surfaces, and said mounting openings being arranged one-half between said locator bore opening and one of said end surfaces and another half between said locator bore opening and another of said end surfaces, and the positional relationship of said one half and said other half of said mounting openings relative to said locator bore opening being identical.

* * * * *